United States Patent [19]

Maekawa et al.

[11] 4,446,174

[45] May 1, 1984

[54] METHOD OF INK-JET RECORDING

[75] Inventors: Masakazu Maekawa; Sukenori Nakamura, both of Shizuoka; Masatoshi Sugiyama; Hideo Odawara, both of Tokyo, all of Japan

[73] Assignee: Fuiji Photo Film Company, Ltd., Kanagawa, Japan

[21] Appl. No.: 144,115

[22] Filed: Apr. 28, 1980

[30] Foreign Application Priority Data

Apr. 27, 1979 [JP] Japan ..... 54-52114
May 14, 1979 [JP] Japan ..... 54-58788

[51] Int. Cl.[3] ..... B41M 3/00

[52] U.S. Cl. ..... 427/261; 346/1.1; 346/135.1; 400/126; 427/214; 427/288; 428/206; 428/207; 428/211; 428/331; 428/409

[58] Field of Search ..... 346/1.1, 135.1; 400/126; 427/261, 288, 146, 212, 214, 258; 428/207, 211, 323, 327, 331, 537, 409, 914

[56] References Cited

U.S. PATENT DOCUMENTS 4,269,891 5/1981 Minagawa ..... 346/135.1

*Primary Examiner*—Bruce H. Hess
*Attorney, Agent, or Firm*—Sughrue, Mion, Zinn, Macpeak and Seas

[57] ABSTRACT

An ink-jet recording method is described for producing a recorded image on an image-receiving sheet with a jet of aqueous ink, wherein an ink jet is projected onto an image-receiving sheet comprising a surface layer containing a pigment, and said surface layer is capable of adsorbing a coloring component in said aqueous ink.

8 Claims, No Drawings

METHOD OF INK-JET RECORDING

BACKGROUND OF THE INVENTION

1. Field of the Invention

This invention relates to an ink-jet recording method, and more particularly, to an ink-jet recording method adapted for multicolor recording.

1. Description of the Prior Art

Because of its quietness, fast recording capability, and adaptability to paper of ordinary grade, ink-jet recording is becoming increasingly popular; for example, one application is in computer terminal printers. Furthermore, the ink-jet method can be used to achieve multicolor recording using a plurality of ink nozzles. However, multicolor ink-jet recording involves problems not encountered in monochrome recording. In monochrome recording, one point on a recording paper is subjected to only one recording operation, and therefore satisfactory recording is obtainable most types of paper, e.g., fine paper, rolled paper for payment slips, and papers having greater degree of ink absorption than those previously mentioned. In multicolor recording, ink is squirted from two or more nozzles, and two or more (sometimes four) dots may be merged at one point on the recording paper. Unless the ink drop is absorbed quickly by the layer of paper, it merges with a subsequent ink drop applied on the same point of paper, causing flowing or flying of the ink and smearing thereof on the white background of the paper. If the recorded paper is handled carelessly, its surface may be rubbed to deface the image. Therefore, the use of recording paper having high ink absorption rate is particularly needed in multicolor recording.

Using a recording paper which absorbs ink well, an ink dot generally spreads and at the same time penetrates deep into the paper. For example, paper made as bulky as possible without using a sizing agent absorbs ink very well, and is therefore feasible for use in multicolor ink-jet printing. But the ink dots spread so much on this paper that they give low resolution, and ink penetrates the paper so deep that light scattering due to the interstices in the upper layer of the paper makes the resulting image whitish and less sharp. If four-color (cyan, magenta, yellow and Indian ink) recording is effected on paper of such high ink absorption, the depth of penetration of the first ink dot in the paper is enough to reduce its visibility from above, resulting in poor color reproduction.

As will be understood from the above discussion, to produce an image of high density, resolution and good color reproduction by multicolor ink-jet printing, the following three apparently incompatible requirements must be satisfied: (1) the coloring component of the ink should not show appreciable spreading on the recording paper used; (2) the greater part of said component should remain on the surface of the paper without penetrating deeply into the paper; and (3) the recording paper should have absorbing properties. Several developments have been made in order to achieve such objectives. For instance, Japanese Patent Application (OPI) No. 53012/77 (the term "OPI" as used herein refers to a "published unexamined Japanese patent application") discloses an ink-jet recording paper wherein raw paper of low size content is coated with a paint which penetrates the layer of paper. Japanese Patent Application (OPI) No. 49113/78 discloses an ink-jet recording paper wherein paper containing a fine powder of urea-formalin resin is impregnated with a water-soluble polymer. Japanese Patent Application (OPI) No. 74340/77 discloses an ink-jet recording paper having a specified degree of air permeability which absorbs ink in a specified period of time. However, the concept common to these three conventional techniques is to sacrifice ink absorption in order to provide high resolution and density. Although they achieve the intended object to some extent, the resulting paper does not absorb ink well and is not suitable for use in multicolor ink-jet recording. Therefore, there has been a demand in the industry for multicolor ink-jet recording paper satisfying the aforementioned three conditions.

SUMMARY OF THE INVENTION

It is therefore an object of the invention to provide a multicolor ink-jet recording method that provides high color density, high resolution, and good color reproduction.

Another object of the invention is to provide an ink-jet recording sheet which absorbs ink well, in which the coloring component in ink does not spread excessively, and into which such coloring component does not penetrate deep.

Still another object of this invention is to provide a multicolor ink-jet recording method that achieves good half-tone reproduction.

These objects of this invention can be achieved by using as an ink-jet recording paper a sheet which comprises a support coated with a surface layer containing a pigment, and said surface layer is capable of adsorbing a coloring component in the ink.

According to this invention, an ink-jet recording method which produces a recorded image on an image-receiving sheet with a jet of aqueous ink is provided, wherein said image-receiving sheet has a surface layer containing a pigment, and said surface layer is capable of adsorbing a coloring component in said aqueous ink. According to this invention, an ink-jet recording sheet is also provided wherein a support is coated with a layer of pigment capable of adsorbing the coloring component in the aqueous ink.

DETAILED DESCRIPTION OF THE INVENTION

The layer of pigment coating capable of adsorbing a coloring component in aqueous ink is such that a direct dye, acid dye or basic dye contained in the aqueous ink is adsorbed onto the pigment, to an adhesive, and/or to an additive contained in the layer of pigment, thereby binding the coloring component to the surfaces of the solid components in said layer of coated pigment.

When a jet of aqueous ink is applied to the ink-jet recording sheet of this invention, the ink is absorbed within the interstices of the surface layer containing the pigment (also referred to herein as the layer of pigment coating) where the dye in the ink is adsorbed, and hence fixed, to the surfaces of the solids in the layer. Water or other solvent in the aqueous ink separates from the dye and penetrates further through the interstices of the pigment layer, as well as through the support (if it can absorb the solvent). As a result, the dye in the aqueous ink does not spread out over the surface of the recording sheet nor does it penetrate the sheet, thus providing a sharp image of high color density, high resolution, and good color reproduction.

In the conventional ink-jet recording sheet, it has been attempted to provide a certain degree of color density and resolution, but these efforts have been far from satisfactory, since such attempts have involved reducing the ability of the sheet to absorb ink to a practically minimum level. In contrast, since the ink-jet recording sheet of this invention is provided for dye absorption in the pigment layer, it can provide a very high degree of color density and resolution without limitation on the ability of the sheet to absorb ink. With such dye adsorptivity provided in the layer of pigment coating, a dye in the ink is bound so firmly to the surfaces of solids in the pigment layer that it will not flow into the interstices of the pigment layer even if another ink drop is absorbed into the layer. Therefore, the ink absorption of the recording sheet of this invention is increased sufficiently for use in multicolor ink-jet recording, and the resulting sheet provides a very high degree of color density without sacrificing the resolution and sharpness of the image.

If an aqueous ink penetrates a recording sheet which is unable to adsorb the dye in the link, the dye diffuses through the sheet together with the solvent. If another ink drop penetrates the sheet at the same location, the dye in the previously absorbed ink diffuses further, providing a blurred image. If the ink does not penetrate the sheet adequately, the excess ink mixes with a subsequent ink drop to provide an undesired color. Therefore, such a recording sheet provides an image of low quality, which is particularly poor in half-tone reproduction, when it is used in multicolor ink-jet recording.

The recording sheet of this invention is also superior to a conventional ink-jet recording paper prepared by impregnating an aqueous solution containing a water-soluble polymeric material or a mixture of a water-soluble polymeric material with a pigment in the surface of raw paper made of wood pulp and filled with a variety of pigments or organic fillers, as described, for instance, in Japanese Patent Application (OPI) Nos. 53012/77 and 49113/78. The essential feature of such conventional ink-jet recording paper is that it is impregnated with a water-soluble polymeric material. Paper filled with a pigment or organic filler absorbs an ink drop well, but, at the same time, the ink dot spreads out on the paper and penetrates deeply into the paper, thus providing an image of low density and low resolution. Therefore, such conventional recording paper as described above attempts to suppress the spreading of the ink dots by impregnating the paper with a water-soluble polymeric material having high water retention characteristics, although this tends to lower the ability of the impregnated paper to absorb ink drops. However, if the recording paper is splashed with water the water-soluble polymeric material (which is not resistant to water) dissolves out of the paper, and the image obtained by ink-jet recording is lost. If, on the other hand, an attempt is made to render the water-soluble polymeric material resistant to water, its water retention characteristics will be reduced or lost, and an ink dot applied will spread outward and penetrate deeply, thus providing low image density and resolution. Therefore, it has been difficult to provide water resistance for a recording paper impregnated with a water-soluble polymeric material.

Compared with these prior art recording sheets, the recording sheet of the invention described herein uses a pigment whose particles can adsorb a dye, and for this reason, regardless of the kind of an adhesive for fixing the pigment, the spreading and penetration of the ink dots is essentially prevented. In other words, whether a water-soluble polymeric material is used as adhesive and made water-resistant, or a hydrophobic latex which is not effective in preventing the spreading of an ink dot is used as an adhesive, the recording sheet of the invention can be used in multicolor ink-jet recording and provides an image of high density and resolution. Furthermore, according to the invention a colored dye contained in ink can be adsorbed on the layer of pigment coating, and therefore, the dye will not dissolve out even if water splashes on the recording sheet. Hence, this invention provides not only a multicolor ink-jet recording image having high density, high resolution, and good color reproduction but also a water-resistant recording sheet and image which have not been satisfactorily obtained using conventional techniques.

In the invention, the use of an acid clay (described in detail below) in the surface layer enables the use of a basic colored dye. Presumably, this is because the basic colored dye is adsorbed on acid clay to become very resistant to light, thus providing a highly light-resistant ink-jet recorded image. As a result, many basic dyes which offer brilliant color but which have not been previously used successfully in ink-jet recording because of their low light-fastness can now be used according to this invention. Such water-soluble dyes that can be employed as basic colored dye include Basic Yellow-2, 3, Basic Red-1, 2, 8, 12, and Basic Blue-5, 7, 9, 24 and 26; for use, the dyes are simply dissolved in water and used as an ink.

The layer of pigment coating according to the invention comprises a pigment, adhesive, and optionally various additives. In most cases, it is sufficient for the practice of the invention that one of such components have the ability to adsorb a dye, but if desired, all components may have dye-adsorbing ability. The pigment is indispensable for forming ink-absorbing interstices in the surface of the support, and the adhesive is indispensable for bonding individual pigment particles with each other and for bonding them with the support.

Suitable examples of the dye-adsorbing pigment include zeolite, vermiculite, kaolinite, halloysite, halloysite treated with acid, acid clay (e.g., montmorillonite, either treated or not treated with acid), attapulgite, diatomaceous earth, silicic anhydride, aluminum silicate, calcium silicate, magnesium silicate, alumina, zirconium salt, fine powder of ion exchange resin and fine powder of urea-formalin resin. For the practice of this invention, a pigment is best suited as a dye-adsorbing component.

The ability of a pigment to adsorb dyes can be evaluated by subjecting the layer of pigment coating to chromatography or by observing a change in the density of a dye added to a dispersion of a pigment. Generally, a basic dye is more easily adsorbed on pigments than a direct dye or an acid dye. Combinations of pigment and dye in aqueous ink preferred for the practice of the invention include zeolite, acid clay, diatomaceous earth and synthetic silicate with a basic dye as well as those of alumina with a direct dye or an acid dye.

When components other than the pigment are being used to adsorb the dyes, pigments commonly employed for the coating of paper, such as talc, calcium carbonate, barium sulfate, calcium sulfate, zinc oxide and fine powder of polystyrene, may also be used. Depending upon the characteristics required for the resulting recording paper, a pigment having the ability to adsorb dyes may be mixed with a pigment not having such an ability. Pigments not capable of adsorbing dyes can be made capable of dye-adsorption by treating the surface of the pigment particles with alumina, silica, or zinc.

The invention can be rendered even more effective by bonding the dye-adsorbing pigment particles with an adhesive having the ability to adsorb dyes. Preferably such a dye-adsorbing adhesive is a polyelectrolyte having a dissociative group capable of bonding with a dissociative group of the dyes being used. The combination of a basic dye and an anionic or amphoteric polyelectrolyte, as well as the combination of a direct dye or an acid dye and a cationic or amphoteric polyelectrolyte, can be used.

Suitable examples of such dye-adsorbing adhesive include sodium polyacrylate, sodium salt of styrene-maleic anhydride copolymer, methyl vinyl ether-maleic anhydride copolymer, ethylene-maleic anhydride copolymer, polystyrene sulfonate salt, carboxymethyl cellulose, cellulose sulfate, carboxy modified polyvinyl alcohol, sodium alginate, gum arabic, emulsion of acrylic ester copolymer having an anionic dissociative group, polyvinyl benzyl trimethylammonium chloride, polydiallyl dimethylammonium chloride, polymethacryloyloxyethyl-$\beta$-hydroxy ethyldimethylammonium chloride, hydrochloride of polydimethylaminoethyl methacrylate, polyethyleneimine, polyamide-polyamine resin, cationic starch, gelatin, casein, soybean protein, acrylic acid-dimethylaminoethyl methacrylate copolymer, and an emulsion of acrylic ester copolymer having a cationic dissociative group.

When components other than the adhesive are being used to adsorb the dyes, adhesives having few or no dissociative groups may be employed. Thus, starch, polyvinyl alcohol, methyl cellulose, hydroxyethyl cellulose, hydroxyethylated starch, polyacrylamide, polyvinyl pyrrolidone, styrene-butadiene copolymer latex, methyl methacrylate-butadiene copolymer latex, and acrylic ester copolymer emulsion may be used under such circumstances. Alternatively, a dye-absorbing adhesive may be combined with an adhesive having no ability to adsorb dyes. For the practice of this embodiment of the invention, the combination of a polyelectrolyte and latex is preferred because not only is a strong bond provided between individual pigment particles, and between the pigment layer and the support, but also a highly water-resistant pigment layer is obtained.

The dye-adsorbing property of the layer of pigment can be conferred by incorporating in it a water-soluble barium salt (e.g., barium chloride), calcium salt, manganese salt or aluminum salt (e.g., aluminum chloride) which reacts with a direct dye or an acid dye in ink to form a lake, or by incorporating phosphorus tungsten molybdic acid, phosphorus tungstic acid, phosphorus molybdic acid, tannic acid, tartar emetic and aliphatic acid which reacts with a basic dye in ink to form a lake. The lake formation also has the effect of providing a colored image of improved light fastness and water resistance.

The layer of pigment is coated from a solution which may also contain a wetting agent or surfactant such as glycerin, polyethylene glycol or pyrrolidone (rendering the pigment layer highly wettable with respect to aqueous inks), a dye or pigment (for toning such as bluing), a fluorescent dye, a UV absorber, a pigment dispersant, defoaming agent, lubricant such as calcium stearate, mildew proofing agent, and an agent for making the adhesive water-resistant such as melamine resin, urea resin, polyamide-epichlorohydrin resin, formalin, glyoxal, epoxy compound, or zirconium compound.

If the components mentioned above exhibit a tendency to agglomerate and not form a uniform pigment coating solution, a separate solution prepared from components other than the pigment and adhesive may be first applied to a support before it is coated with a solution containing the pigment and adhesive.

Suitable examples of the material that can be used as a support for the pigment coating are paper, cloth, plastic film, metal sheet, woodboard and glass sheet. A transparent or translucent support enables a colored image to be observed not only by reflected light but also by transmitted light. Paper used as the support in this invention is primarily made of wood pulp which may be mixed with synthetic fiber, synthetic pulp, or inorganic fiber. The paper may have incorporated therein: (1) a sizing agent such as rosin, alkyl ketone dimer or alkenyl succinic acid; (2) fillers such as clay, talc or calcium carbonate; (3) paper strength modifiers such as polyacrylamide or starch; (4) fixing agents such as aluminum sulfate or cationic polyelectrolyte; (5) wet strength modifiers such as melamine resin, urea resin, or polyamide-polyamine-epichlorohydrin resin; (6) dyes, including fluorescent dyes. A size press may be used to apply a coating of a water-soluble adhesive such as starch, polyvinyl alcohol or gelatin.

If the interstices in the layer of pigment coating are not sufficient to provide the desired ink-absorbing capacity, the support may comprise waterleaf raw paper so that ink can also be absorbed into the raw paper. In this case, the dye in the ink is still adsorbed on the pigment coating, while excess solvent in the ink is absorbed by the raw paper, without causing any decrease in image density, resolution, and color reproduction characteristics.

As described in Japanese Patent Application (OPI) No. 53012/77, when raw paper of low size content is coated with a pigment solution, both the pigment and adhesive penetrate the raw paper, in contrast to this invention, wherein the dye in the ink is selectively adsorbed on the pigment coating, and only the solvent is absorbed into the raw paper.

There are two preferred methods for providing a uniform layer of pigment on unsized raw paper; one is the two-layer coating method wherein coagulation of a coating solution takes place on the surface of the raw paper, and the other method uses only a single coating solution to coagulate. According to the two-layer coating method, a first coating solution which contains a substance that coagulates a pigment coating solution is applied to raw paper which is further coated, optionally after drying, with the pigment coating solution as a second coating solution. Coagulation takes place at the interface of the first and second coating solutions, and this prevents the penetration of the second coating solution into the raw paper, thus forming a uniform layer of pigment on the unsized raw paper. This wet-on-wet coating wherein the second coating solution is applied without first drying the first coated solution is a preferred embodiment for the practice of this invention. Suitable components for the first coating solution include a polyelectrolyte having an electric charge opposite to that of the polyelectrolyte or the pigment in the second coating solution (i.e., the pigment coating solution), as well as acid, alkali, water-soluble inorganic salts and chelate compounds that coagulate the adhesive in the second coating solution. For example, hydrochloric acid, sodium hydroxide, aluminum chloride, EDTA, etc., are used.

In the method that uses a single coating solution to coagulate, the applied pigment coating solution may be immediately brought into contact with an acid, alkali, water-soluble inorganic salt or chelate compound as an aqueous solution or gas that coagulates the adhesive in the coating solution. The adhesive may be coagulated by heat, infrared rays, or ultraviolet rays.

The pigment coating solution is applied to one or both surfaces of the support in a dry weight which generally ranges from about 1 to 30 g per square meter (per surface), and preferably from 5 to 20 g per square meter. If the coating weight is lower, the ink absorption of the resulting recording paper may decrease.

The pigment coating may be applied with a machine commonly employed in the coating of paper with pigments such as air-knife coater, blade coater, bar coater, roll coater, gravure coater or curtain coater. After a pigment coating solution is applied and dried, the coating surface may be rendered smooth on a machine calender, supercalender or gloss calender, as in the case of general purpose pigment-coated paper.

An aqueous ink is generally employed in ink-jet recording, and the aqueous ink used in combination with the ink-jet recording sheet of this invention may contain, if desired or necessary, a water-soluble dye, a wetting agent, a dye solubilizer, a mildew-proofing agent, water or a water-miscible organic solvent. Such components are described, for example, in Japanese Patent Application (OPI) Nos. 12105/72, 97620/74, 143602/75, 102407/75, 129310/76, 137506/76, 137505/76, 115106/76, 139408/76, 12008/77, 12009/77, 12010/77 and 89534/74.

A central feature of this invention is that a strong bond is provided between the dye in the aqueous ink and the layer of pigment coating (i.e., the recording layer) through adsorption, and good results are obtained by performing ink-jet recording using the combination of a specific dye and a pigment coating. It is desired that either the pigment coating be selected to best suit the dye being used in the aqueous ink, or the aqueous ink be selected to contain a dye most suitable for the pigment coating being used. Generally, an acid dye and a direct dye are combined with a pigment coating different from the pigment coating most desirably combined with a basic dye. The combinations of pigment coating and aqueous ink most suitable for the practice of this invention can be effectively determined by paper chromatography on a sheet of pigment coating, as defined below. A colored drop of aqueous ink is placed on the sheet of pigment coating which is immersed in the solvent of the aqueous ink; alternatively, one end of the sheet of pigment coating is immersed in the aqueous ink to have the ink diffuse through the sheet. Rf (flow rate) measurement suggests whether the combination of the sheet of pigment coating and aqueous ink used is proper or not. The Rf value has the same meaning as used in paper chromatography and is defined by the ratio of the travelling distance of dye to that of the solvent in the aqueous ink. The combination of the sheet of pigment coating and aqueous ink that is suitable for the practice of this invention is such that Rf is less than 0.7, preferably less than 0.5.

The ink-jet recording according to this invention has the following advantages: (1) high ink absorption that eliminates a blurred image and stained white background; (2) high image density; (3) high resolution; (4) good color reproduction characteristics; (5) image of great light-fastness; (6) image of high water resistance; and (7) improved light resistance enabling the use of aqueous ink that contains a basic dye, thereby providing a brilliant color.

This invention is hereunder described in greater detail by reference to the following examples and comparative examples.

EXAMPLE 1

100 parts of LBKP were beat to a freeness (C.S.F.) of 430 cc and mixed with 5 parts of talc, 1 part of saponified rosin and 2 parts of aluminum sulfate. The mixture was run on a Fourdrinier machine to provide a web of raw paper having a basis weight of 100 g/m$^2$. A size press was used to coat the web with oxidized starch in a dry weight of 2 g/m$^2$.

A coating solution having a solid content of 30% that consisted of 70 parts of synthetic zeolite, 30 parts of synthetic aluminum silicate, 0.3 part of sodium hexametaphosphate, 10 parts of casein, 10 parts of styrene-butadiene copolymer latex, 1 part of melamine resin and 2 parts of polyethylene glycol was prepared. The coating solution was applied to one side of the previously made raw paper with an air-knife coater in a dry weight of 10 g/m$^2$. After drying, the raw paper was supercalendered to provide a smooth coating surface.

The coating solution was applied to a glass plate. After drying, one end of the glass plate was immersed in cyan ink containing a basic dye as a coloring component. The Rf value measured was 0.43. When the basic dye was replaced by an acid dye, the Rf value was found to be 1.00. Thus, it was concluded that the pigment-coated paper according to this example was suitable for use in recording with aqueous ink containing a basic dye.

EXAMPLE 2

100 parts of LBKP were beat to a freeness (C.S.F.) of 430 cc and mixed with 0.2 part of polyamide-polyamine-epichlorohydrin resin. The mixture was run on a Fourdrinier machine to make a web of raw paper having a basis weight of 100 g/m$^2$. A size press was used to coat the web with cationic starch in a dry weight of 2 g/m$^2$.

A 1% solution of sulfonated polystyrene was prepared as a first coating solution. As a second coating solution, a solution having a solid content of 30% that consisted of 70 parts of synthetic zeolite, 30 parts of diatomaceous earth, 0.3 part of sodium hexametaphosphate, 10 parts of polymethacryloyloxyethyl-$\beta$-hydroxyethyldimethylammonium chloride, 10 parts of cationic acrylic ester copolymer emulsion and 2 parts of melamine resin was prepared. The first coating solution was applied to one side of the previously made raw paper with a roll coater in an amount of 20 cc/m$^2$. Without drying the coating, the second coating solution was applied to one side of the first coating with an air-knife coater in a dry weight of 10 g/m$^2$. After drying, the coated raw paper was supercalendered to provide a smooth coating surface.

The second coating solution was applied to a glass plate. After drying, one end of the glass plate was immersed in cyan ink containing a basic dye as a coloring component. The Rf value measured was 0.43. When the basic dye was replaced by an acid dye, the Rf value was found to be 0.75. Thus, it was concluded that the pigment-coated paper according to this example was suitable for use in recording with aqueous ink containing a basic dye.

COMPARATIVE EXAMPLE 1

100 parts of LBKP were beat to a freeness (C.S.F.) of 430 cc and mixed with 0.2 part of polyamide-polyamine-epichlorohydrin resin. The mixture was run on a Fourdrinier to make a web of raw paper having a basis weight of 100 g/m$^2$. A size press was used to coat the web with oxidized starch in a dry weight of 2 g/m$^2$.

COMPARATIVE EXAMPLE 2

A coating solution having a solid content of 40% that consisted of 100 parts of calcium carbonate, 0.3 part of sodium hexametaphosphate, 10 parts of oxidized starch, 10 parts of styrene-butadiene copolymer latex and 1 part of melamine resin was prepared. The solution was applied to one side of the raw paper of Comparative Example 1 with an air-knife coater in a dry weight of 10 g/m$^2$. After drying, the coated paper was supercalendered to provide a smooth coating surface.

The coating solution was applied to a glass plate. After drying, one end of the galss plate was immersed in cyan ink containing a basic dye as a coloring component. The Rf value measured was 1.00. Thus, it was concluded that the pigment-coated paper prepared in this example was not suitable for use in recording with aqueous ink containing a basic dye or acid dye.

COMPARATIVE EXAMPLE 3

100 parts of LBKP were beat to a freeness (C.S.F.) of 430 cc and mixed with 1 part of rosin emulsion, 0.2 part of polyamide-polyamine-epichlorohydrin resin and 0.2 part of aluminum sulfate. The mixture was run on a Fourdrinier machine to make a web of raw paper having a basis weight of 100 g/m$^2$. A size press was used to coat the web with oxidized starch in a dry weight of 2 g/m$^2$.

COMPARATIVE EXAMPLE 4

The raw paper of Comparative Example 3 was coated with the coating solution of Comparative Example 2 in the same manner as described in Comparative Example 2. Multicolor recording was performed on each of the recording papers of Examples 1 and 2 and Comparative Examples 1, 2 and 3 with four kinds of basic dye containing ink, i.e., cyan ink, magenta ink, yellow ink and Indian ink, that were squirted sequentially from four ink-jet nozzles (dia. 50$\mu$) of an ink-jet printer. The results are shown in Table 1 below.

TABLE 1

| | Ink*1 Absorption | Color*2 Density | Diameter*3 of Ink Dot ($\mu$) | Image Quality |
|---|---|---|---|---|
| Example 1 | very high | 1.42 | 150 | very good |
| Example 2 | very high | 1.45 | 140 | very good |
| Comparative Example 1 | very high | 0.91 | 200–250 | poor |
| Comparative Example 2 | very high | 1.05 | 200 | good |
| Comparative Example 3 | low | 1.13 | 120 | poor |
| Comparative Example 4 | high | 1.20 | 180 | poor |

*1The lesser the overflowing of ink from point of mixing four colors, the better.
*2Measured in solid area of cyan ink.
*3The diameter of one dot of cyan ink.

Ink-jet recording on the papers of Examples 1 and 2 was characterized by an image of very high quality having high ink absorption and image density.

EXAMPLE 3

A coating solution having a solid content of 30% that consisted of 100 parts of alumina-treated talc, 0.3 part of sodium pyrophosphate, 15 parts of gelatin, 10 parts of methyl methacrylate-butadiene copolymer latex and 3 parts of polyamide-polyamine-epichlorohydrin resin was prepared. The solution was applied to one side of the raw paper of Example 1 with an air-knife coater in a dry weight of 15 g/m$^2$. After drying, the coated raw paper was supercalendered to provide a smooth coating surface.

The coating solution was applied to a glass plate. After drying, one end of the glass plate was immersed in cyan ink containing a direct dye as a coloring component. The Rf value measured was 0.59. The pigment-coated paper of this example was suitable for use in recording with aqueous ink containing a direct dye and an acid dye.

Multicolor recording was performed on such paper using cyan ink, magenta ink, yellow ink and Indian ink, each primarily consisting of a direct dye and an acid dye, which were squirted from the nozzles of an ink-jet printer identical with what was used in Comparative Example 4. The image obtained was as good as that obtained using the recording papers of Examples 1 and 2.

EXAMPLE 4

A coating solution having a solid content of 20% that consisted of 100 parts of alumina white, 0.3 part of sodium pyrophosphate and 20 parts of cationic acrylic ester copolymer emulsion was prepared. The solution was applied to one side of a corona-treated polyester film (100$\mu$ thick) with a bar coated in a dry weight of 10 g/m$^2$. After drying, the coated film was supercalendered to provide a smooth coated surface.

Multicolor ink-jet recording was performed on the film in the same manner as Example 3. The film had high ink absorption and provided an image of high density whether it was observed by reflected light or transmitted light.

EXAMPLE 5

100 parts of LBKP were beat to a freeness (C.S.F.) of 430 cc and mixed with 5 parts of talc, 1 part of saponified rosin and 2 parts of aluminum sulfate. The mixture was run on a Fourdrinier machine to provide a web of raw paper having a basis weight of 100 g/m$^2$. A size press was used to coat the web with oxidized starch in a dry weight of 2 g/m$^2$.

A coating solution (I) of this invention having a solid content of 30% was prepared. Its solid content consisted of 100 parts of acid clay, 0.3 part of sodium hexametaphosphate and 10 parts of styrene-butadiene copolymer latex. A control solution (II) having a solid content of 30% was prepared, and its solid content consisted of 100 parts of calcium carbonate, 0.3 part of sodium hexametaphosphate and 10 parts of styrene-butadiene copolymer latex. Another control solution (III) having a solid content of 30% was prepared, and its solid content consisted of 100 parts of kaolin, 0.3 part of sodium hexametaphosphate and 10 parts of styrene-butadiene copolymer latex. Each of the coating solutions (I), (II) and (III) was applied to one side of the previously made raw paper with an air-knife coater in a dry weight of 10 g/m². After drying, three sheets of paper were supercalendered to provide a recording sheet (I) coated with solution (I), control recording sheets (II) and (III) coated with solutions (II) and (III), respectively. Multicolor ink-jet recording was performed on each of the three sheets with three kinds of ink containing Basic Blue 9, Basic Red 8 and Basic Yellow 3, respectively, which were squirted sequentially from the nozzles of an ink-jet printer. The results are indicated in Table 2 below.

TABLE 2

| Sheet No. | Color*1 Density | Diameter*2 of Ink Dot (μ) | Overflowing*3 of Ink | Image Quality |
|---|---|---|---|---|
| (I) | 1.00 | 150–200 | no | very good |
| (II) | 0.75 | 250 | some | good |
| (III) | 0.83 | 250 | much | good |

*1Reflection density at cyan solid area was measured by Macbeth densitometer.
*2The diameter of one dot of cyan ink.
*3Overflowing of ink from point of mixing three colors (cyan, magenta and yellow).

As Table 2 shows, when sheet (I) of this invention was used in multicolor ink-jet recording with basic dye containing inks, there was no flowing of ink and the sheet provided an image of very high quality having high density. In contrast, both control sheets (II) and (III) were inferior to sheet (I) with respect to image density, ink flowing, and image quality. One great advantage of sheet (I) of this invention is that it provided a color image having good half-tone characteristics.

COMPARATIVE EXAMPLE 5

Multicolor ink-jet recording was performed on three sheets (the same as used in Example 5) with three kinds of ink having dissolved therein Acid Blue 120, Acid Red 73 and Acid Yellow 36, respectively, which were squirted sequentially from an ink-jet printer. The results are shown in Table 3 below.

TABLE 3

| Sheet No. | Color*1 Density | Diameter*2 of Ink Dot (μ) | Overflowing*3 of Ink | Image Quality |
|---|---|---|---|---|
| (I) | 0.85 | 250–300 | some | poor |
| (II) | 0.69 | 300 | much | poor |
| (III) | 0.58 | 300–350 | much | poor |

*1, *2, *3: The same as in Example 5.

As Table 3 shows, when acid dye-containing ink was used in multicolor ink-jet recording, there was observed the flowing of the ink from each of sheets (I), (II) and (III) and only poor image having low density was produced. However, it should be emphasized that even in the use of an acid dye, the recording sheet of this invention had generally better characteristics than the control sheets.

As will be clear from the results of Example 5 and Comparative Example 5, when multicolor ink-jet recording was performed according to this invention on a sheet containing acid clay and using ink containing different colored basic dyes, a color image of good quality having high density, high resolution, and good color reproduction characteristics was produced. In addition, a color image with very good half-tone characteristics was obtained.

EXAMPLE 6

100 parts of LBKP were beat to a freeness (C.S.F.) of 430 cc and mixed with 5 parts of talc, and 0.3 part of polyamide-epichlorohydrin resin (as a wet strength modifier) in the form of an aqueous solution. The mixture was run on a Fourdrinier machine to make a web of raw paper having a basis weight of 100 g/m².

Each of coating solutions (I), (II) and (III) prepared in Example 5 was applied to one side of the raw paper with an air-knife coater in a dry weight of 10 g/m². Multicolor ink-jet recording was performed on each of the resulting three sheets under the same conditions as in Example 5. With acid clay contained in sheet of this invention, no ink spreading was observed and an image of good quality having high density was produced. However, there was much spreading of ink on the control sheets, and the images obtained exhibited low color density and poor quality.

While the invention has been described in detail and with reference to specific embodiments thereof, it will be apparent to one skilled in the art that various changes and modifications can be made therein without departing from the spirit and scope thereof.

What is claimed is:

1. An ink-jet recording method for producing a recorded image on an image-receiving sheet with a jet of aqueous ink, wherein an ink-jet is projected onto an image-receiving sheet with a surface layer containing a pigment and an adhesive, and having an Rf value, which is the flow rate measured for a combination of said surface layer and a dye in said aqueous ink, of less than 0.59.

2. An ink-jet recording method as in claim 1, wherein said Rf value is less than 0.5.

3. An ink-jet recording method as in claim 1, wherein said pigment is zeolite, acid clay, diatomaceous earth, or a synthetic silicate, and said aqueous ink comprises a basic dye.

4. An ink-jet recording method as in claim 3, wherein said adhesive is an anionic or amphoteric polyelectrolyte.

5. An ink-jet recording method as in claim 3, wherein said surface layer contains phosphorus tungsten molybdic acid, phosphorus tungstic acid, phosphorus molybdic acid, tannic acid, tartar emetic or aliphatic acid.

6. An ink-jet recording method as in claim 1, wherein said pigment is alumina or particles treated with alumina, and said aqueous ink comprises a direct dye or an acid dye.

7. An ink-jet recording method as in claim 6, wherein said adhesive is a cationic or amphoteric polyelectrolyte.

8. An ink-jet recording method as in claim 6, wherein said surface layer contains a barium salt, a calcium salt, a manganese salt or an aluminum salt.

* * * * *